US011213940B2

(12) United States Patent
Buckley et al.

(10) Patent No.: US 11,213,940 B2
(45) Date of Patent: Jan. 4, 2022

(54) DUAL ENDED HANDLE FOR AN IMPLEMENT

(71) Applicant: Unger Marketing International, LLC, Bridgeport, CT (US)

(72) Inventors: James M. Buckley, New Hartford, CT (US); John Anthony Triunfo, Fairfield, CT (US)

(73) Assignee: UNGER MARKETING INTERNATIONAL, LLC, Bridgeport, CT (US)

( * ) Notice: Subject to any disclaimer, the term of this patent is extended or adjusted under 35 U.S.C. 154(b) by 59 days.

(21) Appl. No.: 16/799,271

(22) Filed: Feb. 24, 2020

(65) Prior Publication Data

US 2020/0276696 A1 Sep. 3, 2020

Related U.S. Application Data

(60) Provisional application No. 62/811,830, filed on Feb. 28, 2019.

(51) Int. Cl.

| | |
|---|---|
| ***B25G 3/04*** | (2006.01) |
| ***B25G 3/12*** | (2006.01) |
| ***B25G 1/04*** | (2006.01) |
| ***B25G 1/10*** | (2006.01) |

(52) U.S. Cl.

CPC ..... *B25G 3/04* (2013.01); *B25G 1/04* (2013.01); *B25G 1/102* (2013.01); *B25G 3/12* (2013.01)

(58) Field of Classification Search

CPC ... B25G 1/04; B25G 3/00; B25G 3/02; B25G 3/04; B25G 3/06; B25G 3/08; B25G 3/10; B25G 3/12; B25G 3/14; B25G 3/16; B25G 3/26; B25G 3/28; B25G 3/30; B25G 3/32; B25G 3/34; Y10T 403/556; Y10T 403/56

USPC ..... 285/7; 403/299, 286

See application file for complete search history.

(56) References Cited

U.S. PATENT DOCUMENTS

| | | | | |
|---|---|---|---|---|
| 1,952,996 A * | 3/1934 | Landgraf | E21B 17/042 | 403/47 |
| 2,163,676 A * | 6/1939 | Gizzarelli | G01R 19/155 | 324/556 |
| 2,705,336 A * | 4/1955 | Wilson | B25G 3/30 | 15/145 |
| 3,574,373 A * | 4/1971 | Le Derf | E21B 17/0426 | 403/296 |
| 4,371,282 A * | 2/1983 | Sturm | B25G 3/10 | 403/277 |
| 4,646,405 A * | 3/1987 | Reinhold | B25G 3/10 | 30/329 |
| 5,133,631 A | 7/1992 | Beach | | |
| 5,609,255 A * | 3/1997 | Nichols | A47L 13/20 | 15/144.3 |

(Continued)

*Primary Examiner* — Jeffrey O'Brien

(74) *Attorney, Agent, or Firm* — Cantor Colburn LLP

(57) ABSTRACT

A dual ended handle such as that used with cleaning implements is provided. The dual ended handle comprises a pole with a first end and a second end, the first end having a first threaded fastener and an implement connecting feature having a tapered cone, the second end having a second threaded fastener and a locking member. A grip having a first end is configured to releasably engage at least one of the first threaded fastener or the implement connecting feature, and a second end configured to releasably engage the second threaded fastener.

16 Claims, 17 Drawing Sheets

(56) References Cited

U.S. PATENT DOCUMENTS 5,647,591 A * 7/1997 Parsons ..... F21L 4/00 362/102
5,692,856 A * 12/1997 Newman, Jr. ..... B25G 1/04 403/109.5
6,073,642 A * 6/2000 Huang ..... A45B 9/00 135/114
6,199,245 B1 * 3/2001 Blessing ..... B25G 1/06 16/422
6,349,451 B1 * 2/2002 Newman ..... A46B 17/02 15/145
6,658,689 B2 * 12/2003 Vosbikian ..... A46B 7/04 15/145
6,865,776 B2 * 3/2005 Spinelli ..... B25G 1/04 16/110.1
7,028,375 B1 * 4/2006 Schaefer ..... B25G 3/00 15/145
7,413,366 B2 * 8/2008 Bensussan ..... B25G 1/04 15/145
7,549,195 B2 * 6/2009 Bensussan ..... B25G 1/04 15/144.4
7,721,391 B2 * 5/2010 Bukovitz ..... B25G 3/14 16/429
8,006,350 B2 * 8/2011 Chen ..... B25G 3/02 16/422
8,745,837 B2 * 6/2014 Bensussan ..... B25G 3/38 29/436
8,875,350 B2 * 11/2014 Bukovitz ..... C08F 293/00 16/429
8,991,012 B1 * 3/2015 Hilbrant ..... B25G 3/28 16/427
9,050,717 B2 * 6/2015 Mouch ..... B25G 3/26
9,731,409 B2 * 8/2017 Meinzer ..... B25F 1/02
9,764,458 B1 * 9/2017 Resh ..... B25G 1/04
10,259,114 B2 * 4/2019 Deville ..... B25G 3/30
10,441,120 B1 * 10/2019 Sgroi, Jr. ..... B25G 1/04
D866,899 S * 11/2019 Harrington ..... D32/52
10,611,013 B2 * 4/2020 Cavaliere ..... B25G 1/04
10,744,635 B1 * 8/2020 Stratton ..... B25G 1/04
10,849,277 B2 * 12/2020 Bian ..... B25F 5/02
D907,474 S * 1/2021 Buckley ..... D8/396
11,027,410 B2 * 6/2021 Barnaal ..... B25G 1/04
D926,553 S * 8/2021 Buckley ..... E21B 17/0426 D8/322
2003/0180085 A1 * 9/2003 Hughes ..... A01B 1/227 401/289
2003/0204926 A1 * 11/2003 Jurgens ..... B25G 1/04 15/144.3
2006/0218752 A1 * 10/2006 Potempa ..... B05C 17/0205 16/429
2007/0089255 A1 * 4/2007 Michelson ..... A47L 13/20 15/144.3
2007/0098487 A1 * 5/2007 Kim ..... B25G 3/18 403/109.1
2007/0163065 A1 * 7/2007 Chang ..... B25G 1/04 15/144.4
2008/0276429 A1 * 11/2008 Bukovitz ..... B25G 3/14 16/429
2010/0263133 A1 * 10/2010 Langan ..... B25D 1/00 7/143
2012/0098282 A1 * 4/2012 Langan ..... A01B 1/20 294/49
2012/0230798 A1 9/2012 Sterle
2015/0217440 A1 * 8/2015 Levesque ..... B25G 3/30 403/341
2016/0288310 A1 * 10/2016 Larouche ..... B08B 1/002
2017/0057074 A1 * 3/2017 D'Avignon ..... B26B 23/00
2017/0113340 A1 * 4/2017 Tomasovich ..... B25G 3/36
2018/0335063 A1 * 11/2018 Gooden ..... B25G 1/04
2019/0148922 A1 * 5/2019 Williams ..... B25G 1/04 254/134.3 R
2020/0230451 A1 * 7/2020 Haggett ..... B25F 1/02
2020/0276695 A1 * 9/2020 Buckley ..... A47L 13/50
2020/0391371 A1 * 12/2020 Nelson ..... A01D 7/02
2021/0107132 A1 * 4/2021 Spinelli ..... A47L 13/42

* cited by examiner

DUAL ENDED HANDLE FOR AN IMPLEMENT

CROSS REFERENCE TO RELATED APPLICATIONS

This application claims the benefit of U.S. Provisional Application Ser. No. 62/811,830, filed Feb. 28, 2019, the entire disclosure of which is incorporated herein by reference.

BACKGROUND

It is often desirable to use an extension handle or pole in conjunction with an implement to reach places that are otherwise hard to reach. For example, a painter may use an extension handle in conjunction with a mop head in order to more easily clean floors. There are many situations and tasks that can be simplified by attaching an extensions handle or pole to an implement.

Unfortunately, implements may use a number of different connection mechanisms, resulting in the user have to obtain, store and transport a number of different handles or poles to accommodate different situations that may occur during the use of the implement.

Accordingly, while existing handles and pole are suitable for their intended purposes the need for improvement remains, particularly in providing a handle or pole that may be coupled to different implements having different connection mechanisms while keeping the same level of end-user comfort/gripping ability

BRIEF DESCRIPTION

According to one aspect of the disclosure a dual ended handle is provided. The dual ended handle comprises a pole with a first end and a second end, the first end having a first threaded fastener and an implement connecting feature having a tapered cone, the second end having a second threaded fastener and a locking member. A grip having a first end is configured to releasably engage at least one of the first threaded fastener or the implement connecting feature, and a second end configured to releasably engage the second threaded fastener.

Additionally or alternatively, in this or other embodiments, the second end further comprises at least one locking tooth configured to engage the locking member and selectively prevent unthreading of the grip. Additionally or alternatively, in this or other embodiments, the locking member includes a locking arm configured to engage the at least one locking tooth. Additionally or alternatively, in this or other embodiments, the at least one locking tooth is disposed within a recess. Additionally or alternatively, in this or other embodiments, the second threaded fastener is within a first counter bore extending from the recess.

Additionally or alternatively, in this or other embodiments, the first end includes an opening sized to receive the tapered cone, the opening having a tapered portion positioned to engage the tapered cone when the grip is coupled to the first end. Additionally or alternatively, in this or other embodiments, the first threaded fastener is within a second counter bore extending from the opening. Additionally or alternatively, in this or other embodiments, the first threaded fastener and the second threaded fastener are the same thread size. Additionally or alternatively, in this or other embodiments, the grip includes a hole extending therethrough transverse to a longitudinal axis of the grip.

According to another aspect of the disclosure a dual ended handle is provided. The dual ended handle includes a hollow pole with a first end and an opposing second end. A connection member is coupled to the first end, the connection member having a first threaded fastener and an implement connecting feature having a tapered cone. A locking member is coupled to the second end, the locking member having a second threaded fastener and a locking means. A grip is provided having a first end and a second end, the first end being configured to selectively couple with the connection member, the second end being configured to selectively couple with the locking member.

Additionally or alternatively, in this or other embodiments, the locking means includes at least one arm that is movable between a first position and a second position. Further, the grip second end includes a recess having at least one locking tooth, the at least one arm and at least one locking tooth cooperating to selectively prevent uncoupling of the grip from the locking member when the grip is coupled to the locking member. Additionally or alternatively, in this or other embodiments, the grip member is configured to uncouple from the locking member when the at least one arm is in the first position. Additionally or alternatively, in this or other embodiments, the grip second end includes a second threaded counter bore sized to couple with the second threaded fastener.

Additionally or alternatively, in this or other embodiments, the at least one arm moves from the second position to the first position in response to contacting the at least one tooth as the second threaded fastener is coupled to the second threaded counter bore. Additionally or alternatively, in this or other embodiments, the grip first end includes an opening having a tapered portion, the tapered portion engaging the tapered cone when the grip is coupled to the connection member. Further, the grip first end includes a first threaded counter bore sized to couple with the first threaded fastener. Additionally or alternatively, in this or other embodiments, the grip further includes a hole extending therethrough, the hole being arranged transverse to a longitudinal axis of the grip.

According to yet another aspect of the disclosure a dual ended handle is provided. The dual ended handle includes a pole with a first end and a second end, the first end having a first threaded fastener and an implement connecting feature having a tapered cone, the second end having a second threaded fastener and a locking member. A grip having an end is configured to releasably engage the first threaded fastener the second threaded fastener and the locking member.

Additionally or alternatively, in this or other embodiments, the end is further includes at least one locking tooth configured to engage the locking member and selectively prevent unthreading of the grip. Additionally or alternatively, in this or other embodiments, the locking member includes a locking arm configured to engage the at least one locking tooth. Additionally or alternatively, in this or other embodiments, the at least one locking tooth is disposed within a recess. Additionally or alternatively, in this or other embodiments, the end further includes a threaded counter bore extending from the recess.

According to yet another aspect of the disclosure a grip for a dual ended handle is provided. The handle includes a pole with a first end and a second end, the first end having a first threaded fastener and an implement connecting feature having a tapered cone, the second end having a second threaded fastener and a locking member. The grip includes a first end configured to releasably engage at least one of the first threaded fastener or the implement connecting feature. A second end is configured to releasably engage the second threaded fastener.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments of the present disclosure provide for a handle or pole that is used with a plurality of implements. Embodiments of the present disclosure further provide for a handle or pole that is configured to couple with implements having different connection means.

Referring now to FIG. 1-FIG. 6, an embodiment is shown of a handle 100. The handle 100 includes an elongated pole 102 having a first or bottom end 104 and an opposing second or top end 106. The pole 102 may be made from any suitable material, such as but not limited to aluminum, steel, fiberglass, carbon fiber and epoxy, metal alloys, wood, or a combination of the forgoing with or without grips, texture, surface treatments, etc. It should be appreciated that while the illustrated embodiment shows the pole 102 has having a uniform circular cross section, this is for example purposes and the claims should not be so limited. In other embodiments, the pole 102 may have a different shaped cross-section. Further, the illustrated embodiment shows the pole 102 as being a thin walled tube, this is also for example purposes and in other embodiments, the pole 102 may be solid or partially solid.

Figure 1:
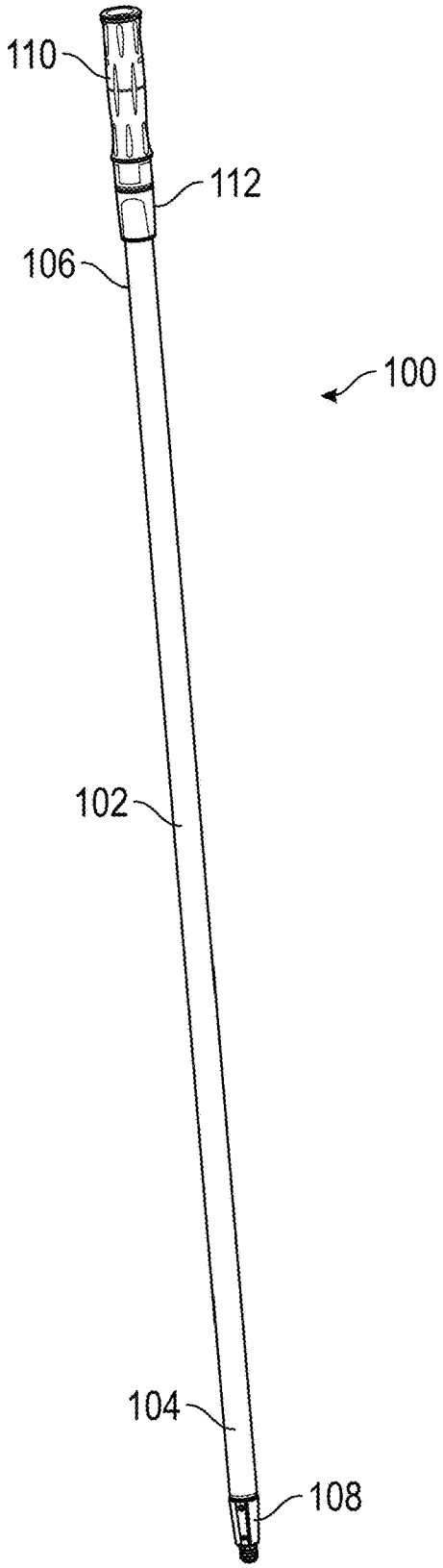
FIG. 1 is a perspective view of a handle in accordance with an embodiment.
Figure 2:
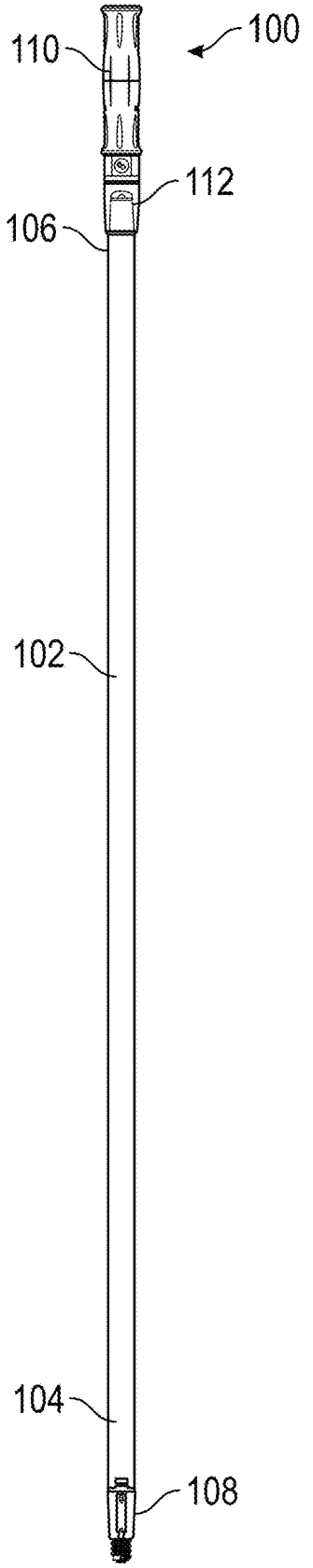
FIG. 2 is a front view of the handle of FIG. 1, the rear view being a mirror image thereof.
Figure 3:
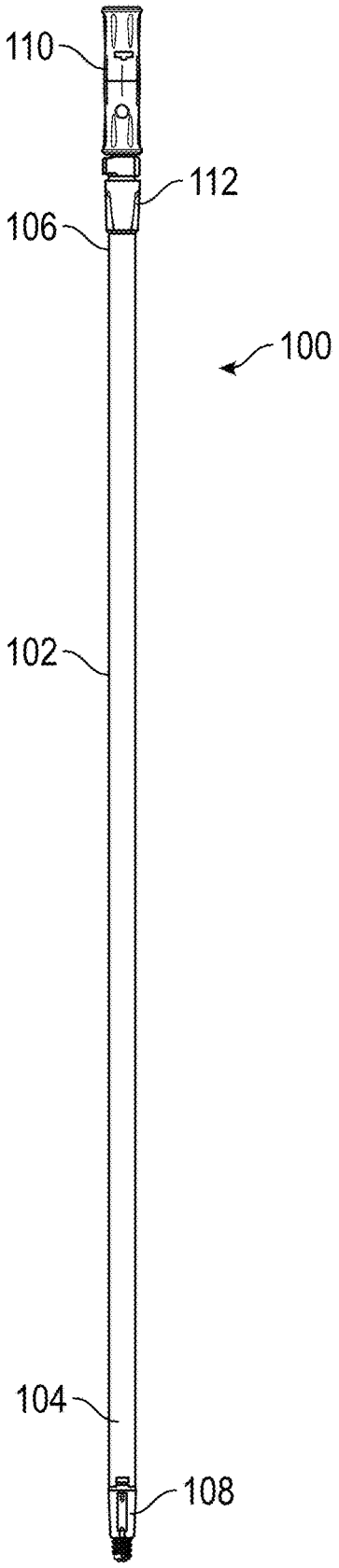
FIG. 3 is a side view of the handle of FIG. 1, the opposite side being a mirror image thereof.
Figure 4:
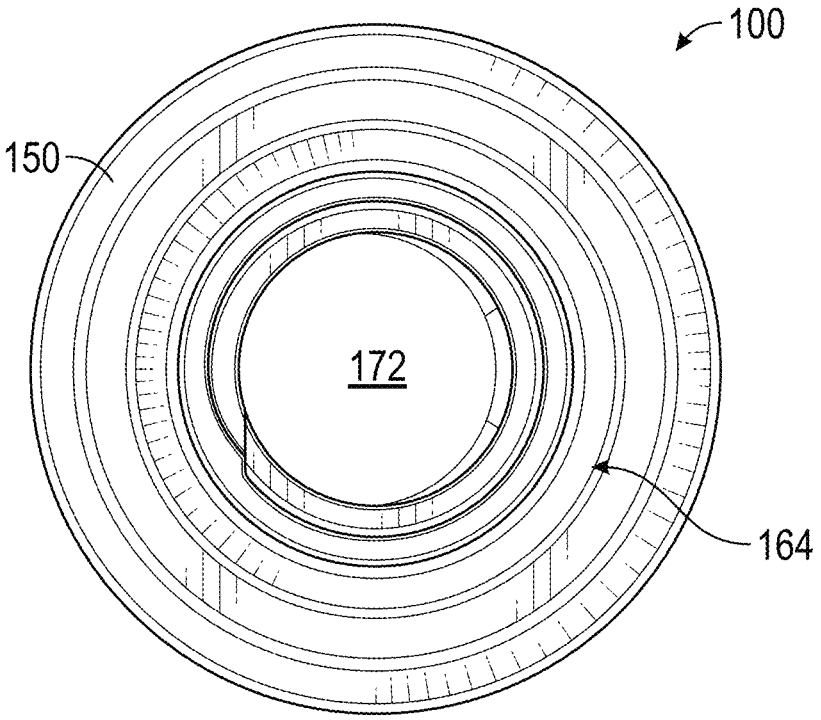
FIG. 4 is a top end view of the handle of FIG. 1.
Figure 5:
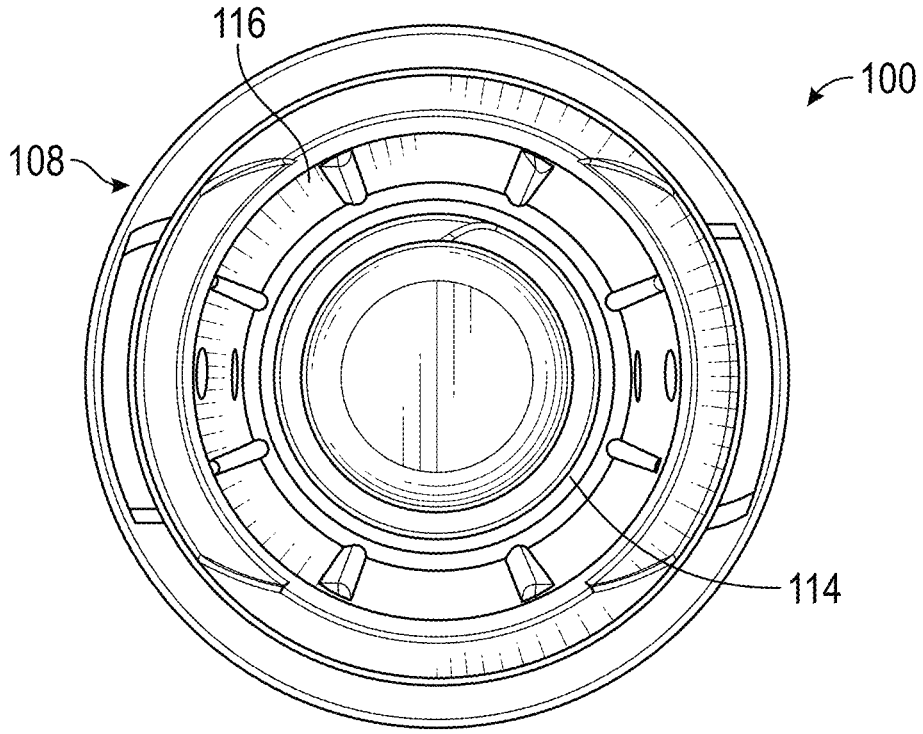
FIG. 5 is a bottom end view of the handle of FIG. 1.
Figure 6:
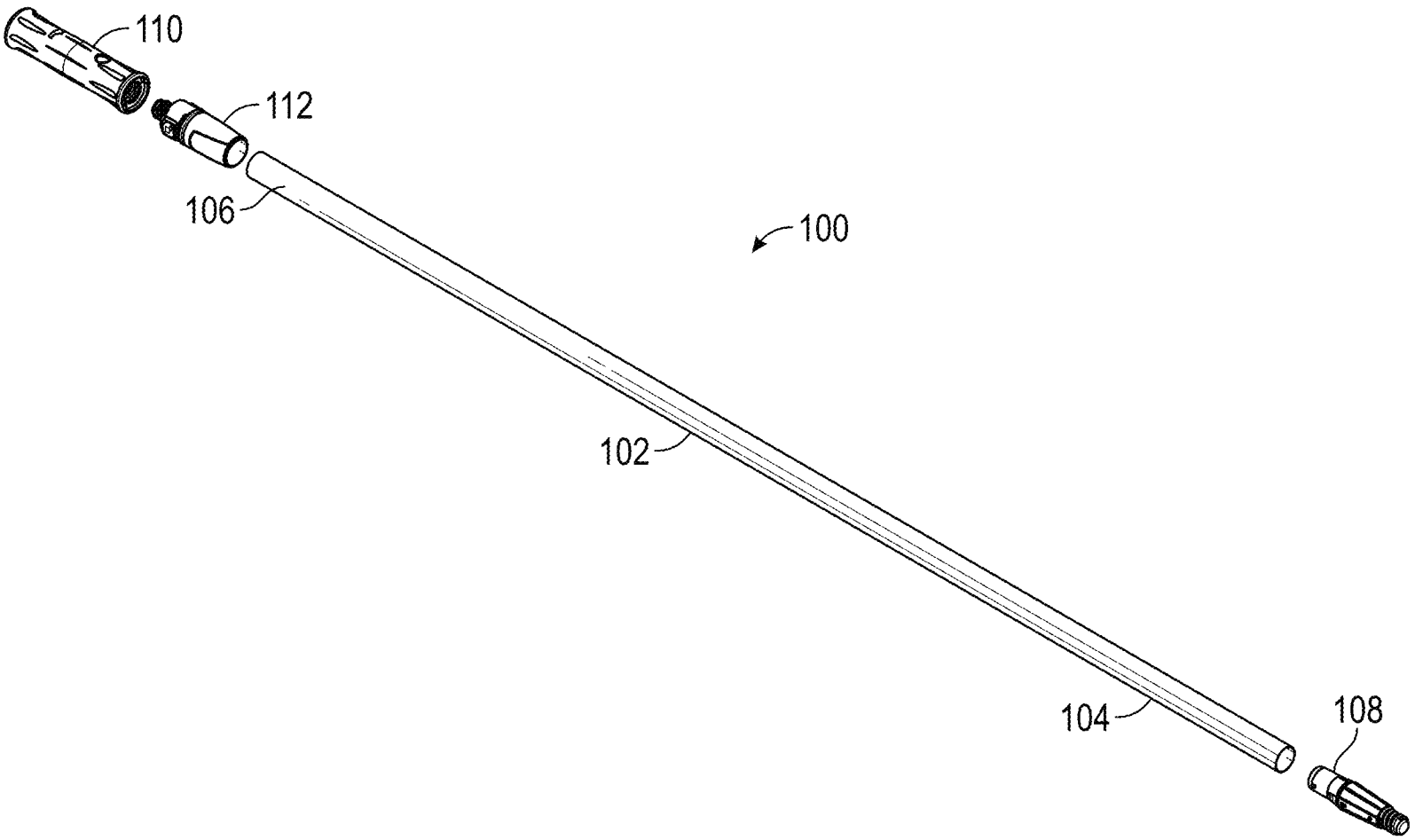
FIG. 6 is a disassembled view of the handle of FIG. 1.
Figure 7:
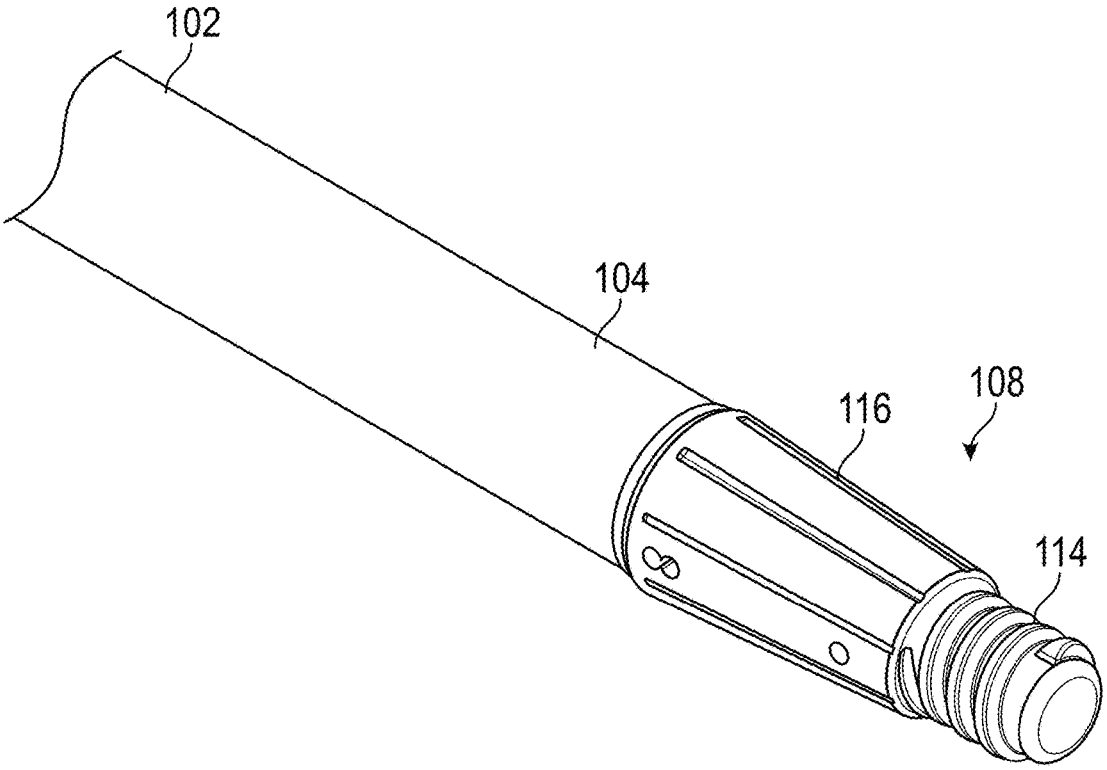
FIG. 7 is an enlarged view of the bottom end of the handle of FIG. 1 with the grip member removed.
Figure 8:
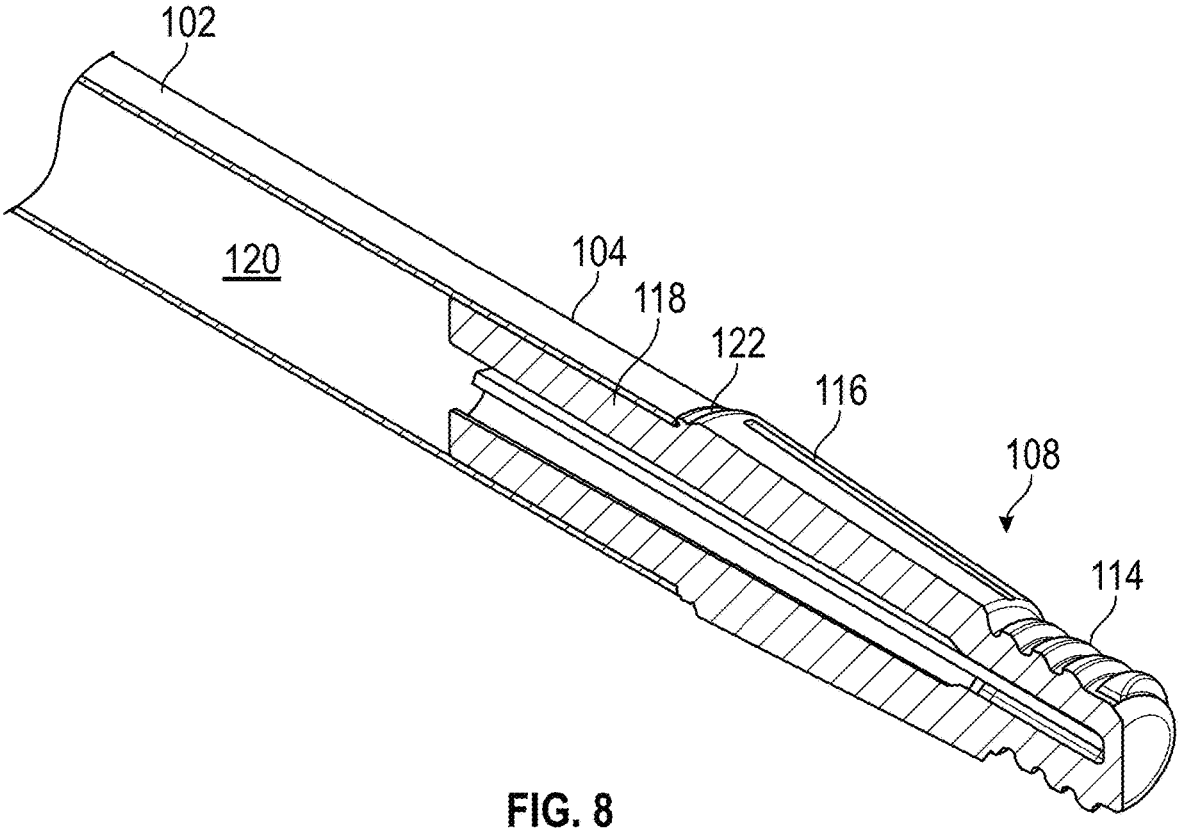
FIG. 8 is a partial section view of the bottom end of FIG. 7.
Figure 9:
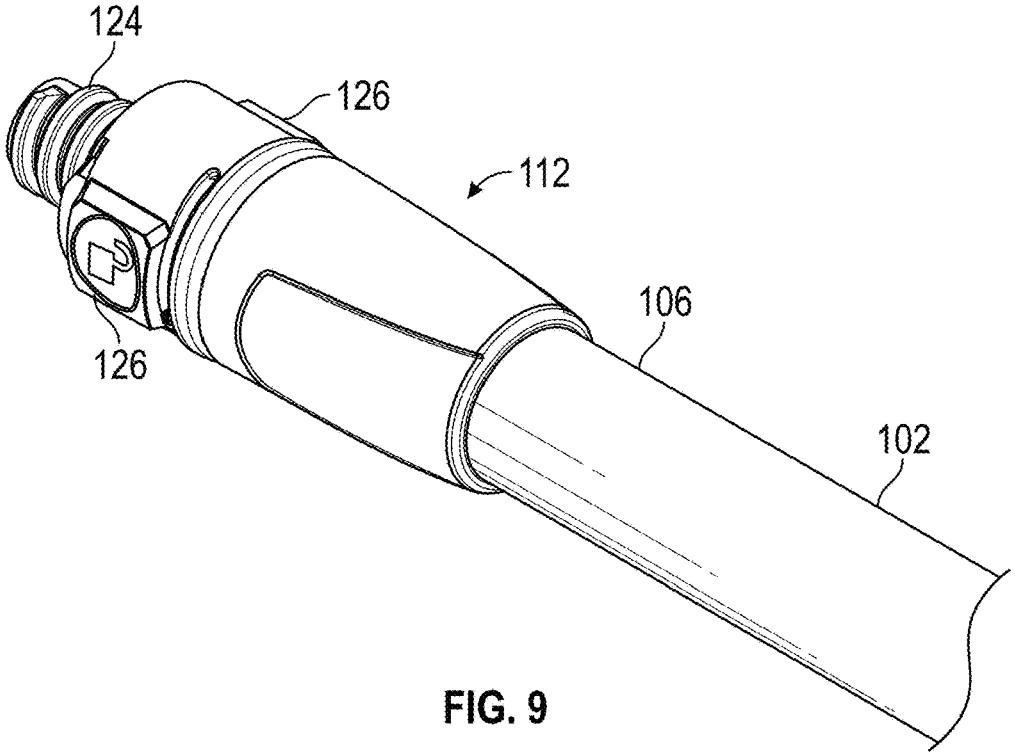
FIG. 9 is an enlarged view of the top end of the handle of FIG. 1, with the grip member removed.
Figure 10:
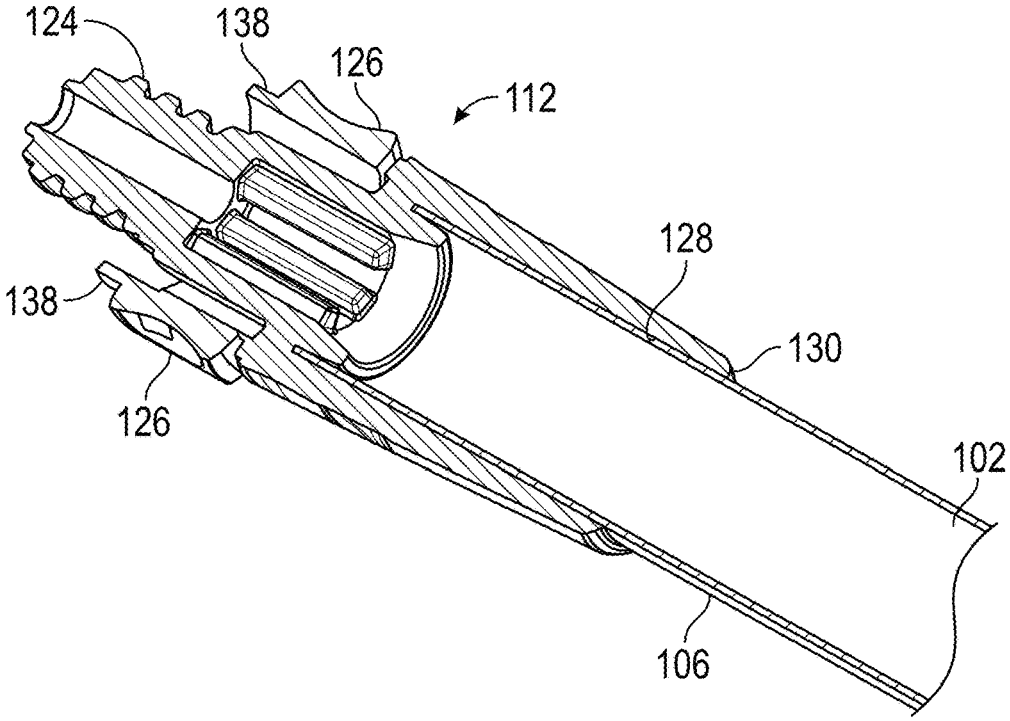
FIG. 10 is a partial section view of the top end of FIG. 9.

Coupled to the bottom end 104 is a connecting member 108. As will be discussed in more detail herein the connecting member 108 includes an implement fastener 114 and an implement connecting feature 116 (FIG. 7 and FIG. 8). In the illustrated embodiment, the connecting member 108 includes a cylindrical boss 118 that is sized to fit within the hollow interior 120 of the pole 102. In an embodiment, the boss 118 is press fit into the bottom end 104 and/or crimped or adhesive. In an embodiment, the connecting member 108 includes a shoulder 122 that the end of the pole 102 may contact when the connecting member 108 is coupled to the pole 102. The fastener 114 and connecting feature 116 cooperate to selectively couple either an implement, or a grip member 110. As used herein, an implement may be a cleaning tool, such as but not limited to a brush, a broom, or a floor squeegee for example. In an embodiment, the implement may be the cleaning element described in commonly owned U.S. Pat. No. 7,549,195B2 and U.S. Pat. No. 8,745,837B2, the contents of which are incorporated by reference herein. Coupled to the top end 106 is a locking member 112. As will be discussed in more detail herein, the locking member 112 includes a fastener 124 and a pair of opposing locking arms 126. The locking arms are movable between a first and second position to selectively engage a cam surface on either the grip member 110 or the desired implement. When the locking arms 126 engage the cam surface, the locking member 112 is coupled to the grip member 110 or the desired implement. The locking member 112 includes an opening 128 on an end 130 that is sized to receive the end 106 of the pole 102. In the illustrated embodiment, the locking member 112 is press fit onto the end 106 of pole 102. In other embodiments, the locking member 112 may be coupled using other fastening means, such as but not limited to crimping, adhesive bonding, screws, bolts or a combination of the foregoing.

Figure 11:
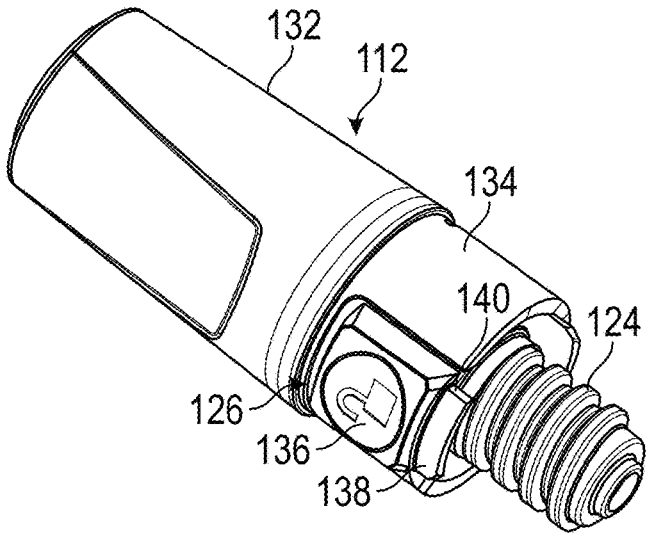
FIG. 11 is a perspective view of the locking member for the handle of FIG. 1.
Figure 12:
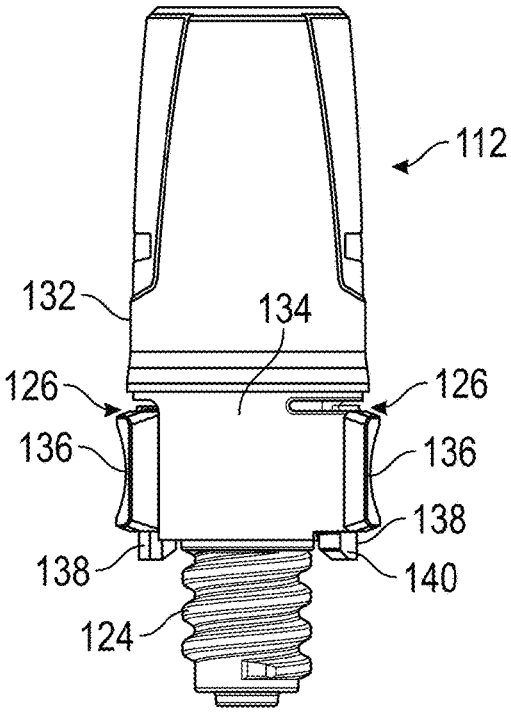
FIG. 12 is a side view of the locking member of FIG. 11.
Figure 13:
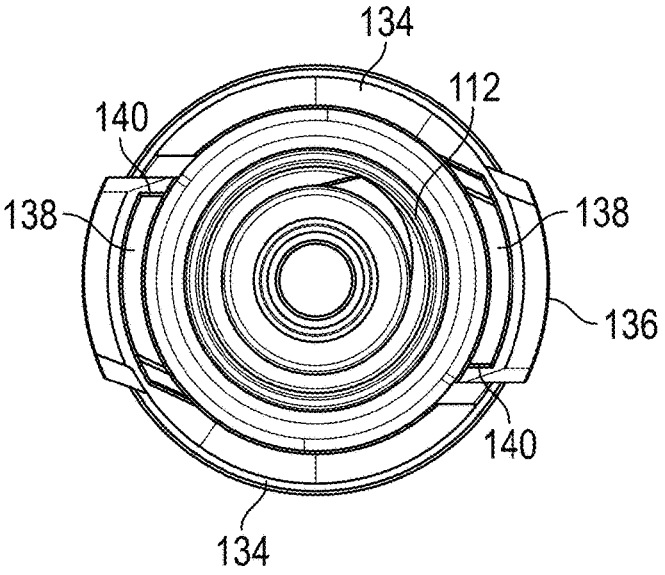
FIG. 13 is an end view of the locking member of FIG. 11.
Figure 14:
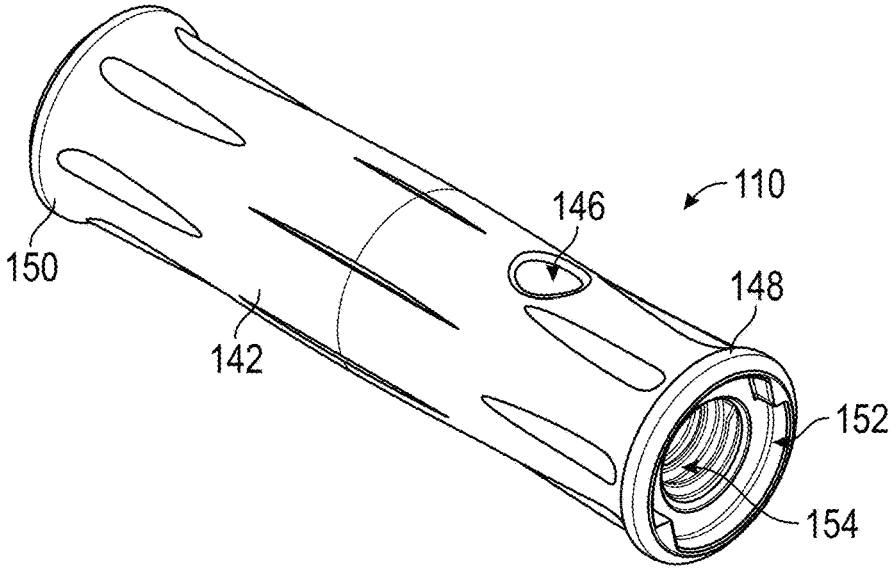
FIG. 14 is a perspective view of the grip member of for the handle of FIG. 1.
Figure 15A:
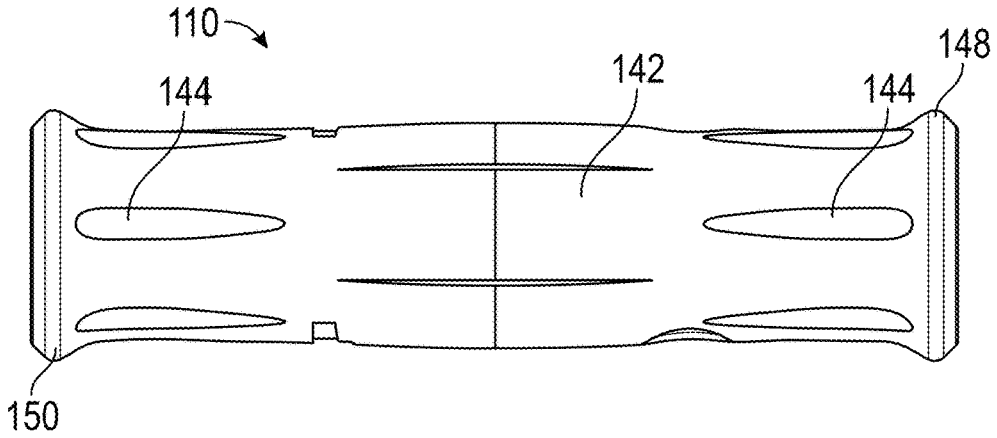
FIG. 15A is a first side view of the grip member of FIG. 14. the opposite side being a mirror image thereof.
Figure 15B:
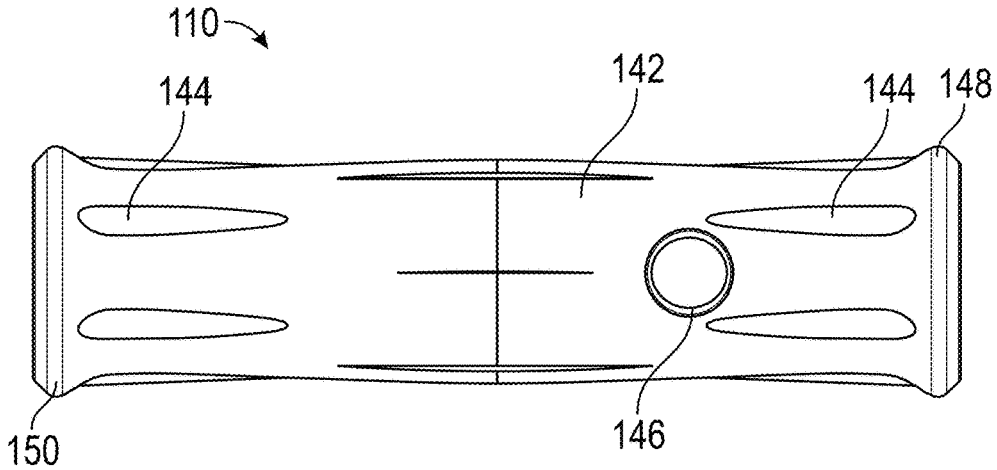
FIG. 15B is a second side view of the grip member of FIG. 14, the opposite side being a mirror image thereof.
Figure 16:
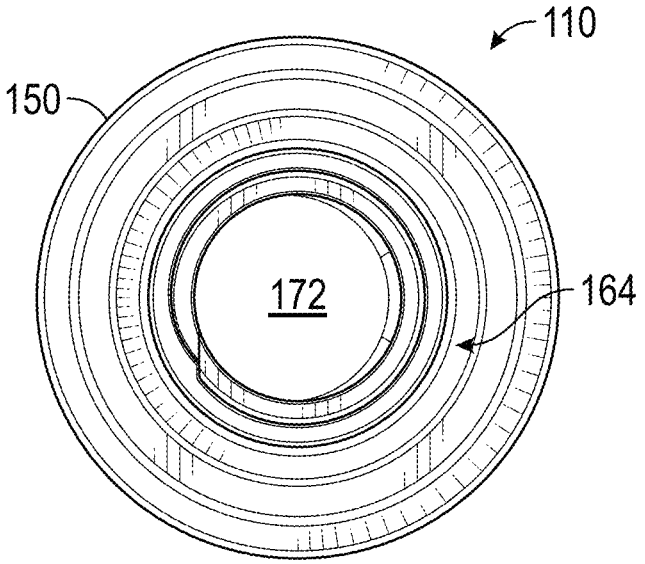
FIG. 16 is a first end view of the grip member of FIG. 14.
Figure 17:
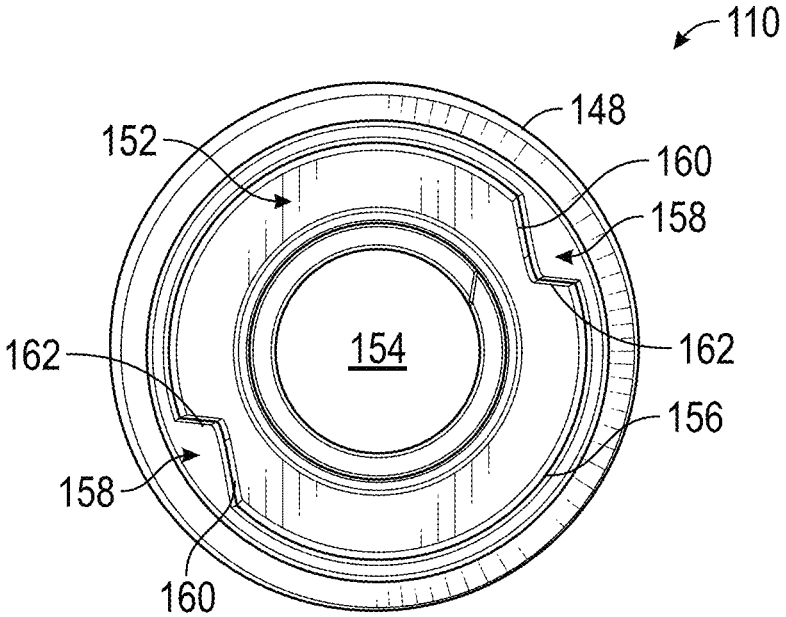
FIG. 17 is a second end view of the grip member of FIG. 14.
Figure 18:
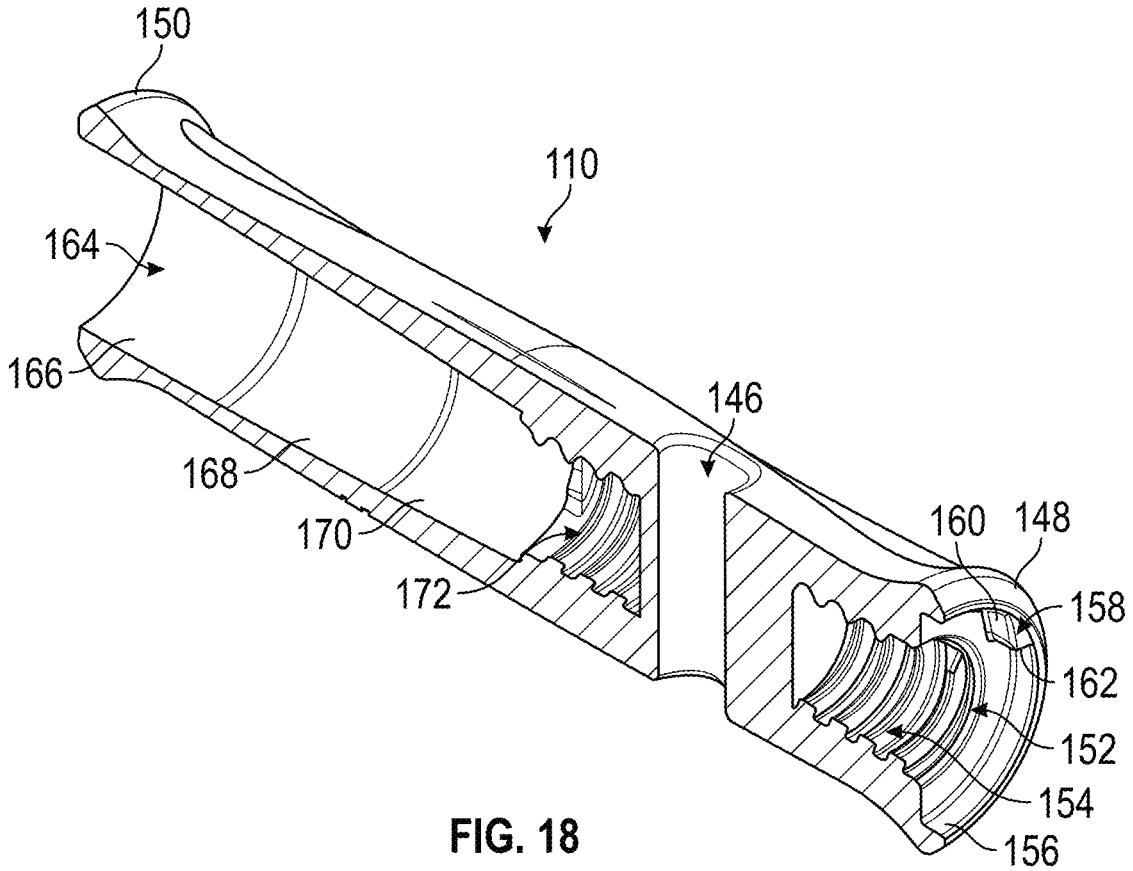
FIG. 18 is a first perspective sectional view of the grip member of FIG. 14.
Figure 19:
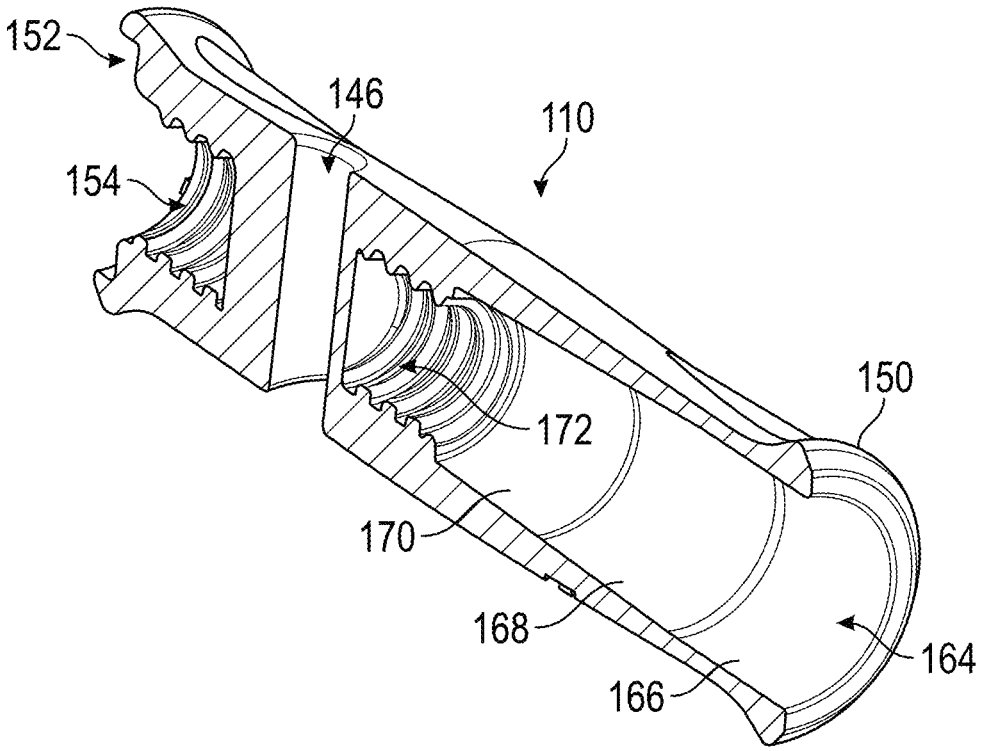
FIG. 19 is a second perspective sectional view of the grip member of FIG. 14.
Figure 20:
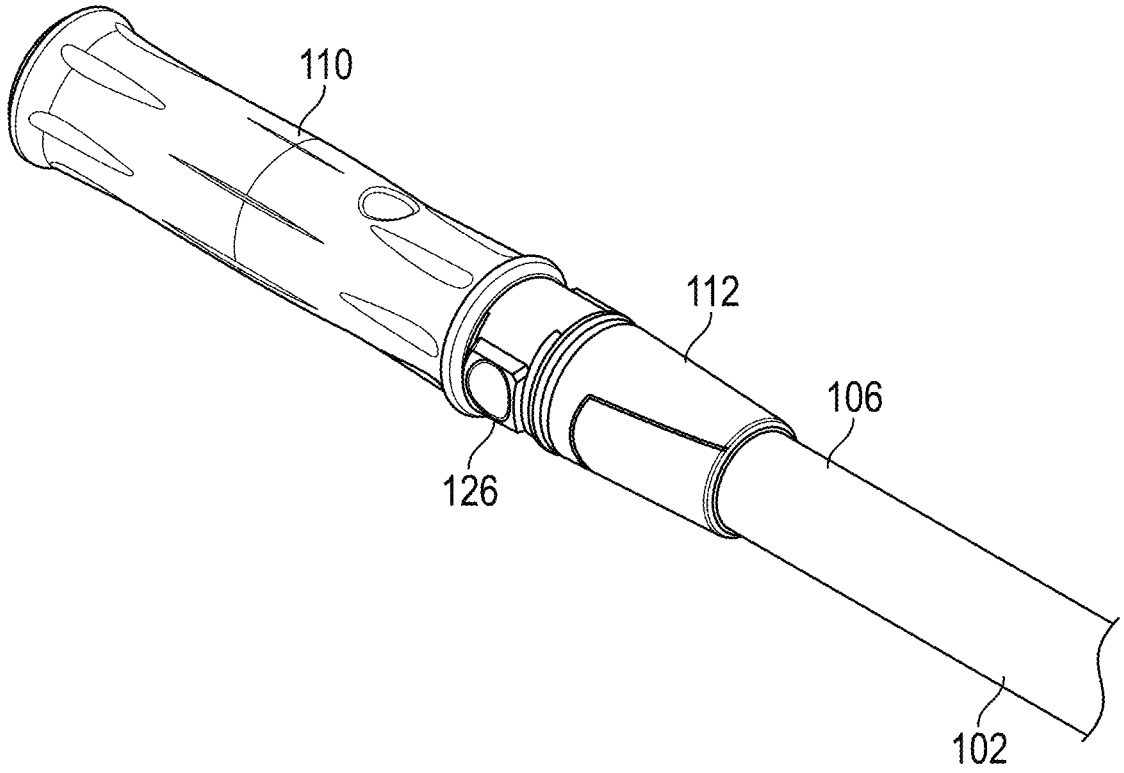
FIG. 20 is an enlarged top end perspective view of the grip member coupled to the locking member.
Figure 21:
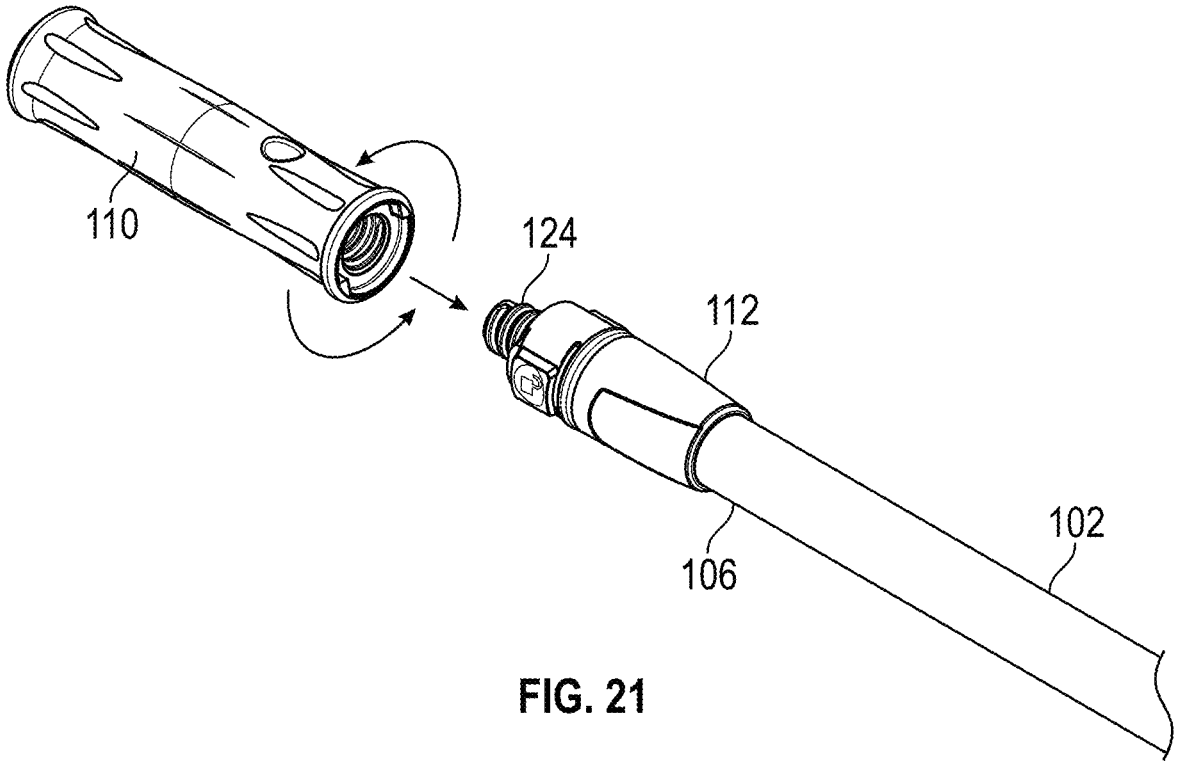
FIG. 21 is a perspective view of the grip member being installed on the locking member.
Figure 22:
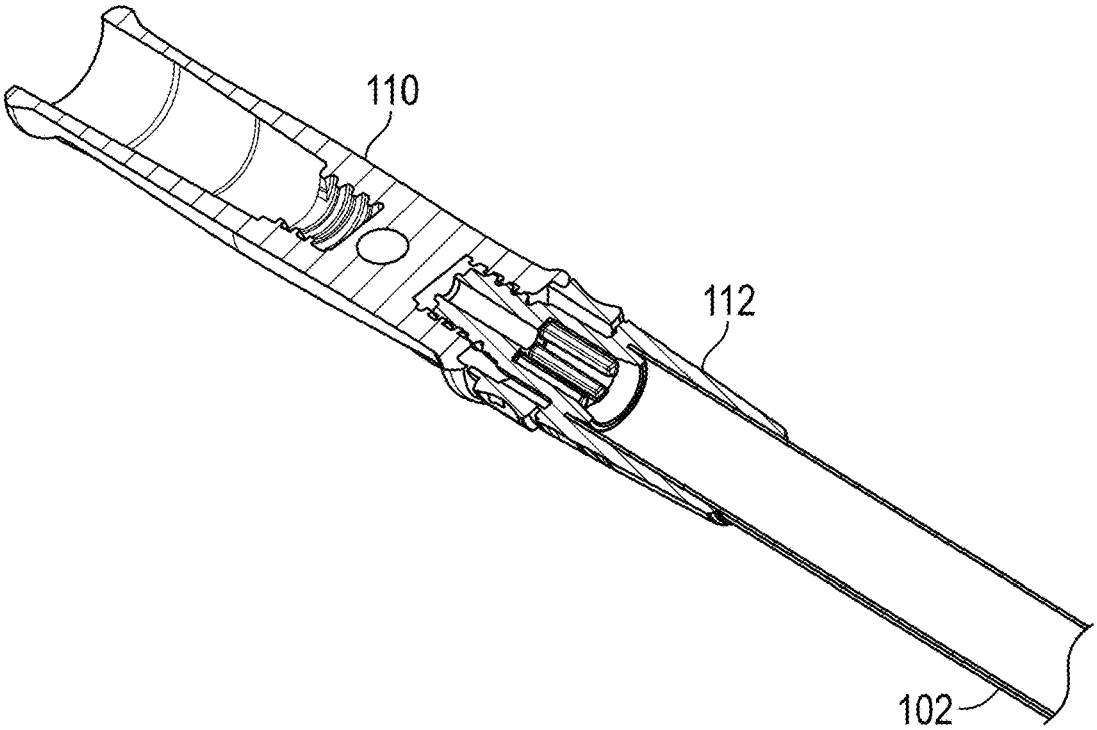
FIG. 22 is a perspective sectional view of the grip member installed on the locking member.

Referring now to FIG. 11-FIG. 13, an embodiment of the locking member 112 is shown. The locking member 112 includes a body 132 with a pair of semi cylindrical projections 134 extending therefrom. Extending from one side of each of the projections 134 are locking arms 126. In the illustrated embodiment, the locking arms 126 are semi-cylindrically shaped and have a raised portion 136 that provides a location for the user to press on the respective locking arms 126. Extending axially from a side of the locking arm opposite the body 132 is a tab 138 having a locking surface 140. As discussed in more detail herein, the locking surface 140 engages a second locking surface on a cam to prevent rotation of the locking member 112 relative to the grip member 110 or the desired implement.

In an embodiment the locking member 112 is made from a suitable material to allow the locking arms 126 to flex, move or rotate between a first or unlocked position and a second or locked position. In an embodiment, the locking portion forms a living hinge. The locking member is made from polymers such as acrylonitrile butadiene styrene (ABS), polypropylene (PP), and polyoxymethylene (POM) for example. In some embodiment, locking members could be molded together (integral) or connected as a separate part and made of metal, steel/stainless steel.

Referring now to FIG. 14-FIG. 19, an embodiment is shown of the grip member 110. The grip member 110 includes a contoured outer surface 142 that is shaped to be comfortably held by the operators hand in a variety of different positions. The surface 142 may a curves or ribs 144 that facilitate or improve the operator's grip of the grip member 110. In an embodiment, an optional hole 146 may extend through the grip member 110. The hole 146 provides a convenient means for the user to hang or store the handle 100. The grip member 110 includes a first end 148 and a second end 150. As will be discussed in more detail herein, each end 148, 150 is configured to couple with a different implement connecting means.

The first end 148 includes a recess 152 having a threaded counter bore 154. The recess 152 includes a sidewall 156 (FIG. 18) that includes and at least one locking tooth 158. In the illustrated embodiment, the recess has a pair of equally spaced or opposing locking teeth 158. It should be appreciated that the recess 152 may include any suitable number of locking teeth 158. The locking teeth 158 each include a cam surface 160 and a locking surface 162. Extending into the grip member 110 is the threaded counter bore 154. In the illustrated embodiment, the threaded counter bore is a fastener sized to cooperate with the fasteners 114, 124 to selectively couple the grip member 110 to the locking member 112 or connecting member 108. In an embodiment, the recess 152 and the counter bore 154 are arranged coaxially with the longitudinal axis of the grip member 110.

The second end 150 includes an opening 164 that extends into the grip member 110. In the illustrated embodiment, the opening 164 includes a cylindrical portion 166, a first conical or tapered portion 168, and a second conical or tapered portion 170. A threaded counter bore 172 extends from the bottom of the opening 164. The opening 164 is sized to receive the connecting member 108. As will be discussed in more detail below, in an embodiment the surfaces 166, 168, 170 engage the implement connecting feature 116 and the threaded counter bore 172 cooperates with the fastener 114 to couple the grip member 110 to the connecting member 108. The conical interior surface could have clearance or tight fit when threaded together.

In the illustrated embodiment, the threaded counter bore 154 includes the same thread size as the threaded counter bore 172. However, it is contemplated that the counter bores 154, 172 may have different thread sizes to accommodate the desired implements.

Referring now to FIG. 20-FIG. 25, the operation is shown of the handle 100 being configured to selectively couple the grip member 110 with either the locking member 112 or the connecting member 108. It should be appreciated that when the connecting member 108 is coupled to a first implement, such as a floor squeegee, window squeegee, duster, or mop for example, the grip member 110 may be coupled to the locking member 112 to provide the user with a comfortable means for holding the handle 100. Similarly, when the locking member 112 is coupled to a second implement (e.g. a brush, broom, floor squeegee, etc.), the grip member 110 may be coupled to the connecting member 108 to allow the user with a comfortable measure for holding the handle 100. Thus, the handle 100 provides advantages of allowing the operator to couple the handle 100 to two different implements having two different connection means. It should be appreciated that this provides advantages in reducing the number of handles the operator needs to acquire, maintain, transport and store.

FIG. 20-FIG. 23C illustrate the coupling of the grip member 110 to the locking member 112. The grip member 110 is aligned with the locking member 112 with the recess 152 facing the fastener 124. The fastener 124 is inserted into the counter bore 154 and the grip member 110 is rotated (as indicated by arrow 174) to engage the threads. The engagement of the threads causes the grip member 110 to translate axially towards the pole 102. It should be appreciated that while embodiments herein describe the grip member 110 as being rotated and the pole 102 being held fixed, this is for example purposes and in other embodiments the pole 102 may be rotated and the grip member 110 held fixed, or the pole 102 and grip member 110 may be rotated simultaneously. Further, it should be appreciated that the implement may be coupled in the same manner, either by rotating the implement onto the threads, or by rotating the pole to engage the threads.

Figure 23A:
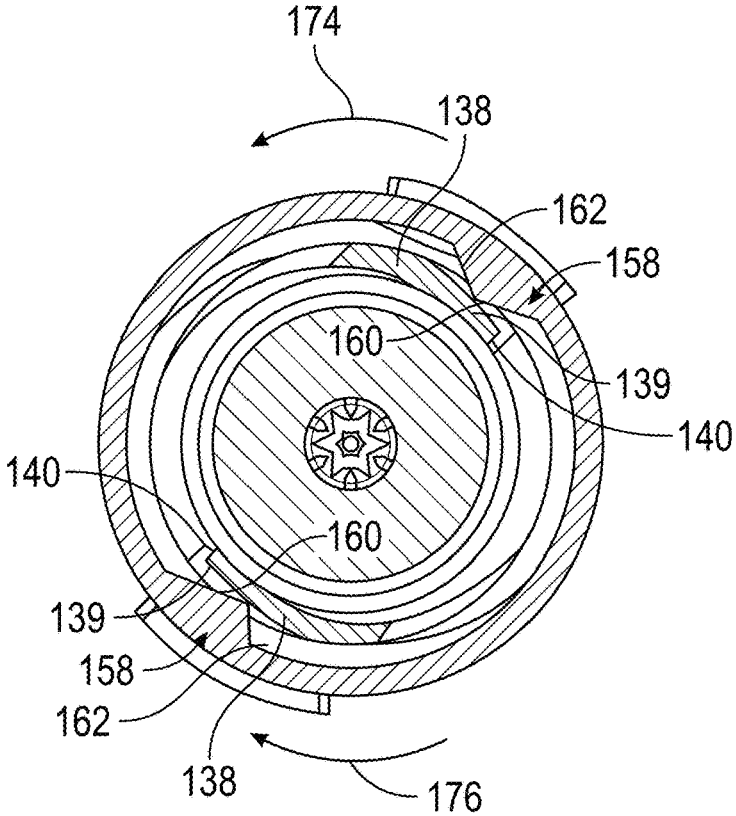
FIG. 23A is a partial sectional view of the locking member and grip member with the locking arms in a first position.
Figure 23B:
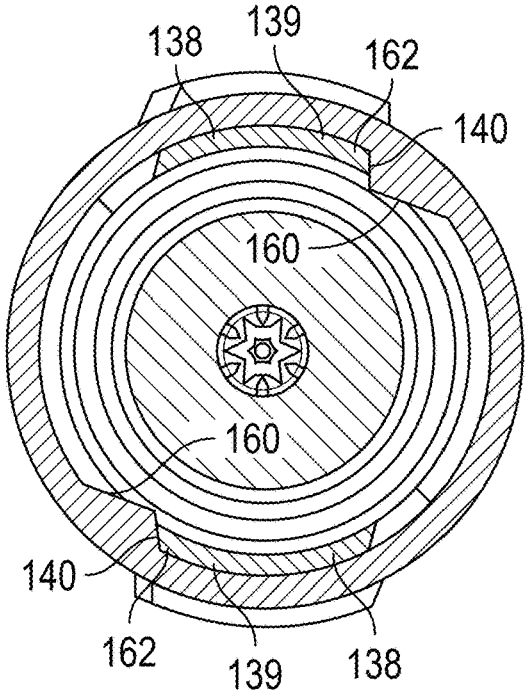
FIG. 23B is a partial sectional view of the locking member and grip member with the locking arms in a second position.
Figure 23C:
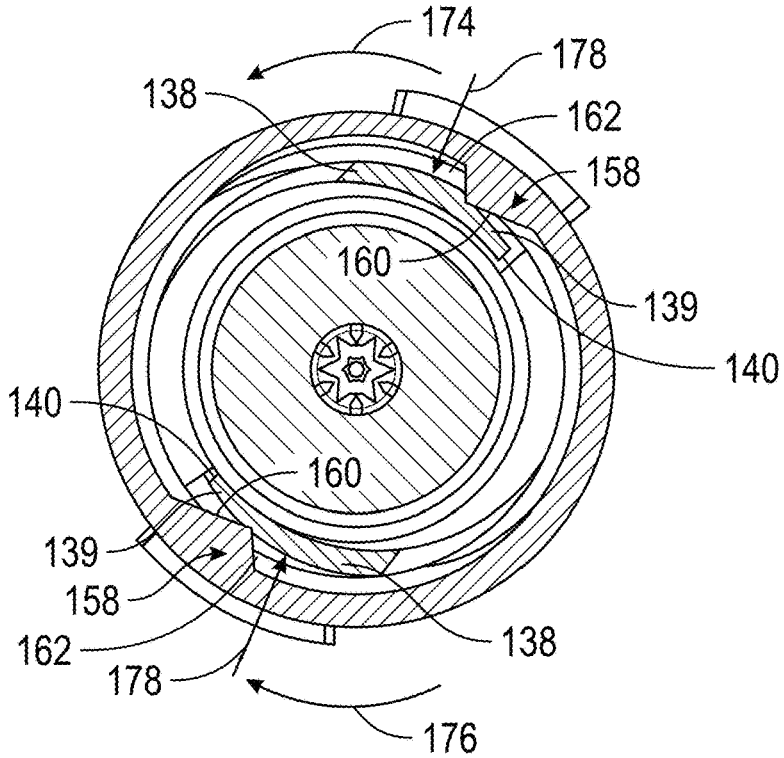
FIG. 23C is a partial sectional view of the locking member and grip member with the locking arms in a first position upon the application of a releasing force.
Figure 24:
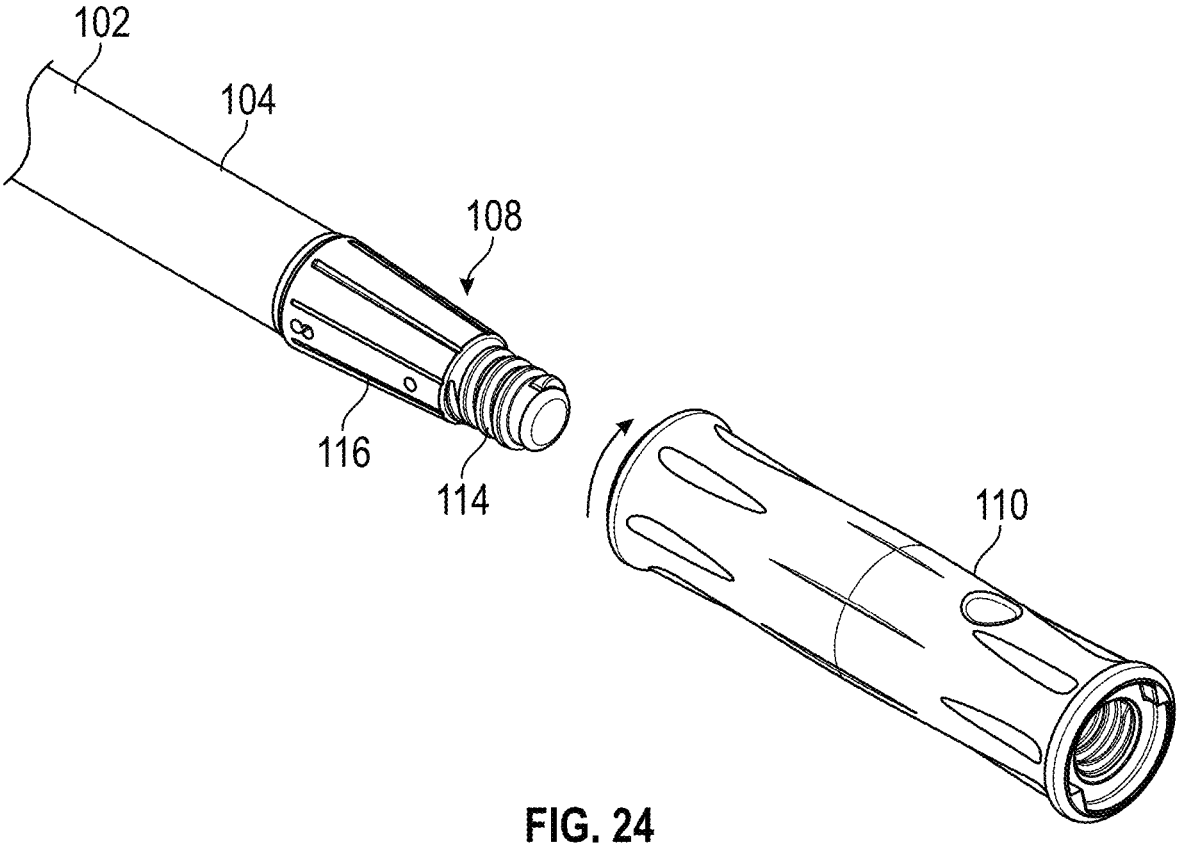
FIG. 24 is an enlarged bottom perspective view of the grip member being installed on the connecting member.
Figure 25:
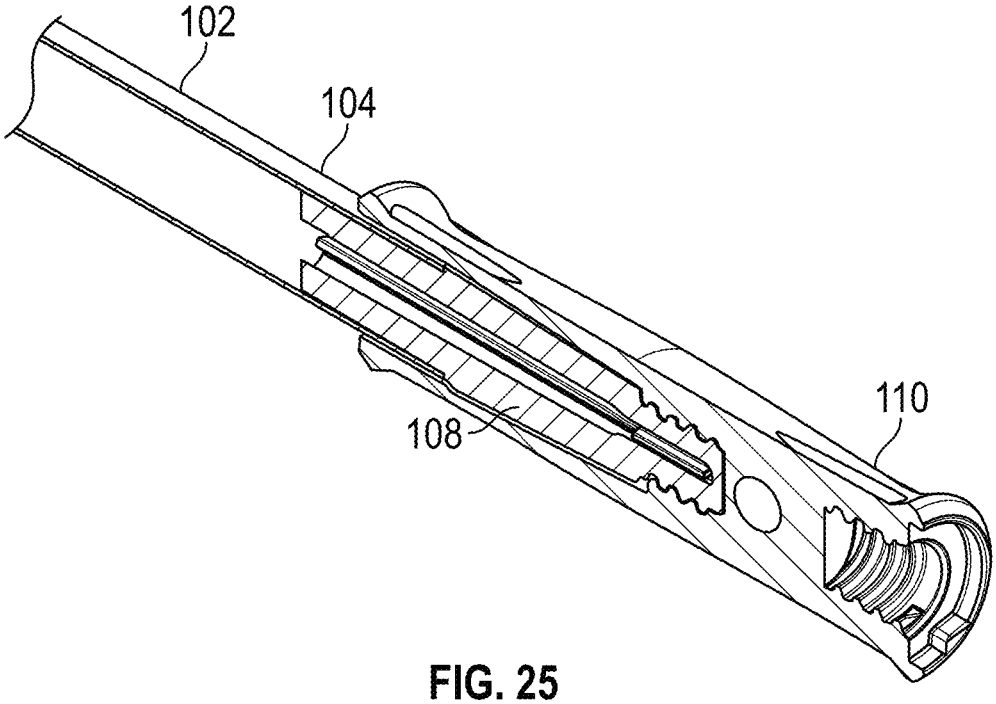
FIG. 25 is a perspective view of the grip member installed on the connecting member.

As the grip member 110 translates axially, the tabs 138 will enter the recess 152 and the outer surface 139 of the tab 138 will contact the cam surface 160 causing the locking arm 126 to deflect to the first position (FIG. 23A). This deflection of the locking arm 126 continues until the edge of the locking surface 140 rotates past the intersection of the cam surface 160 and the locking surface 162. At this point, the locking arm 126 elastically moves or deflects to the second position (FIG. 23B). It should be appreciated that once the lock arm 126 moves to the second position, if the operator were to rotate the grip member 110 in the opposite direction (such as to remove the grip member 110 from the locking member 112, as indicated by arrow 176), the rotation would only continue until the locking surface 140 contacts or engages the locking surface 162. Thus, the grip member 110 will not unthread from the handle 100 during use.

When the operator desires to use an implement that couples with the locking member 112, the operator disengages the locking surfaces 140, 162 by applying a release force 178 to the raised portions 136 on the locking arms 126 simultaneously. In an alternative embodiment, the device could only have one locking tab. The release force 178 moves the locking arms 126 inward to the first position. In the first position, the locking surfaces 140, 162 no longer interfere with each other, allowing the rotation of the grip member 110 in the direction indicated by arrow 176 to unthread the grip member 110 from the locking member 112. In an embodiment, locking position is between 0 and 45 degrees between 140 and 162 when the thread is tightened, To connect the grip member 110 to the connecting member 108, the operator rotates the grip member 110 to align the opening 164 with the fastener 114. The fastener 114 is inserted into the opening 164 to engage the fastener 114 with the threaded counter bore 172. As the grip member 110 is rotated on the fastener 114, the grip member 110 translates axially towards the pole 102. This rotation continues until the surfaces 166, 168, 172 engage the implement connecting feature 116. This stops the axial travel and the grip member 110 is coupled to the connecting member 108.

Figure 26A:
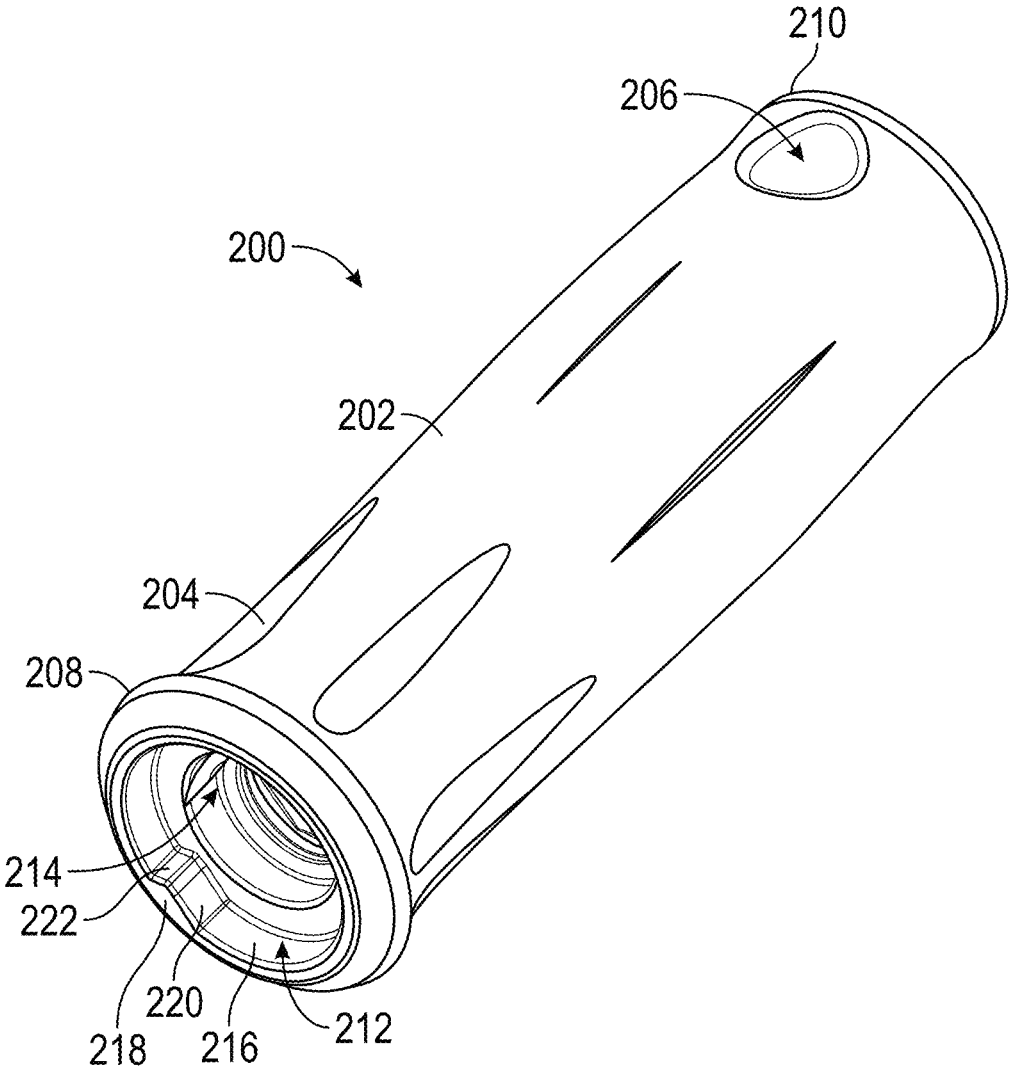
FIG. 26A, FIG. 26B, and FIG. 26C are views of a grip member in accordance with another embodiment.
Figure 26B:
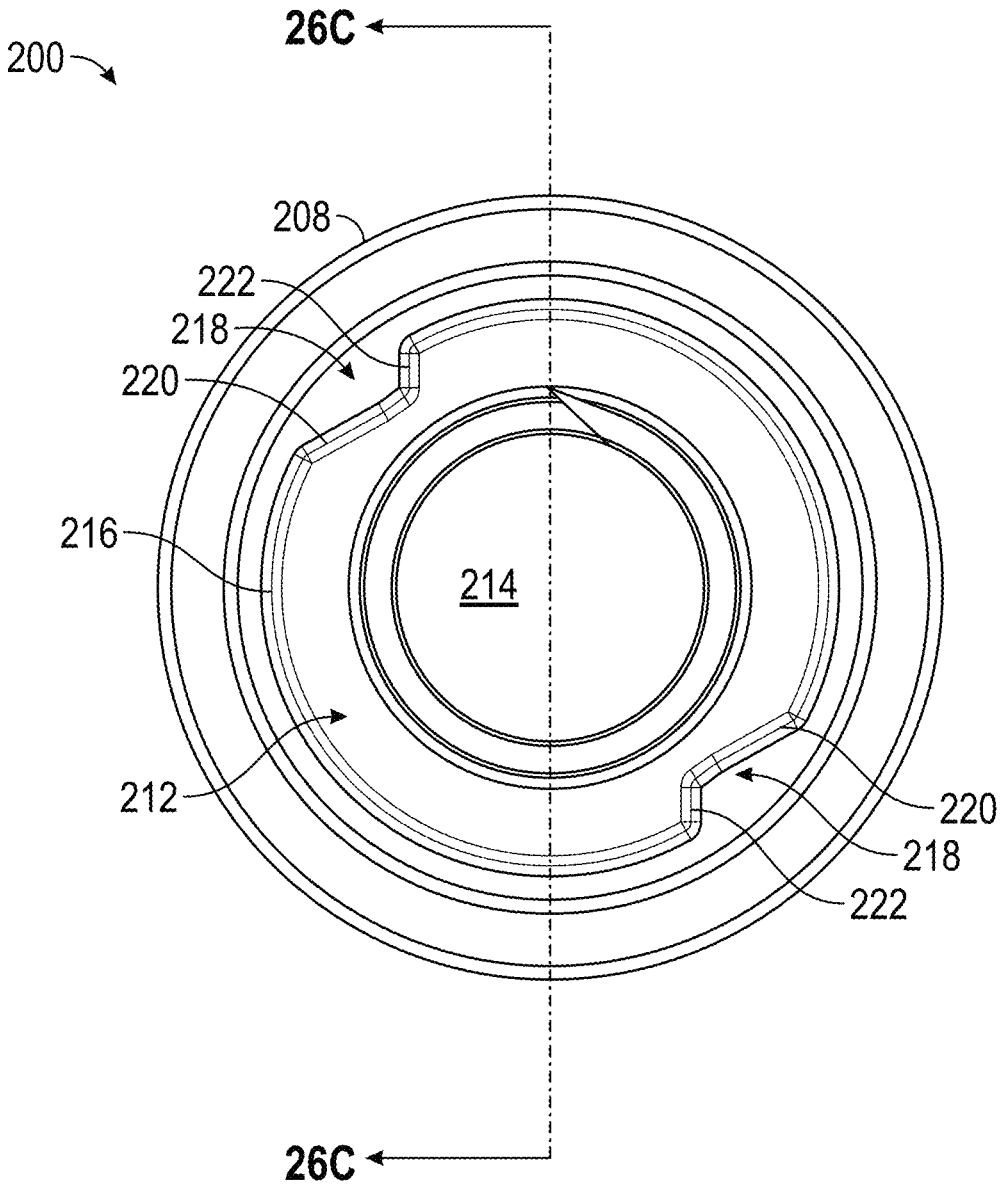
Figure 26C:
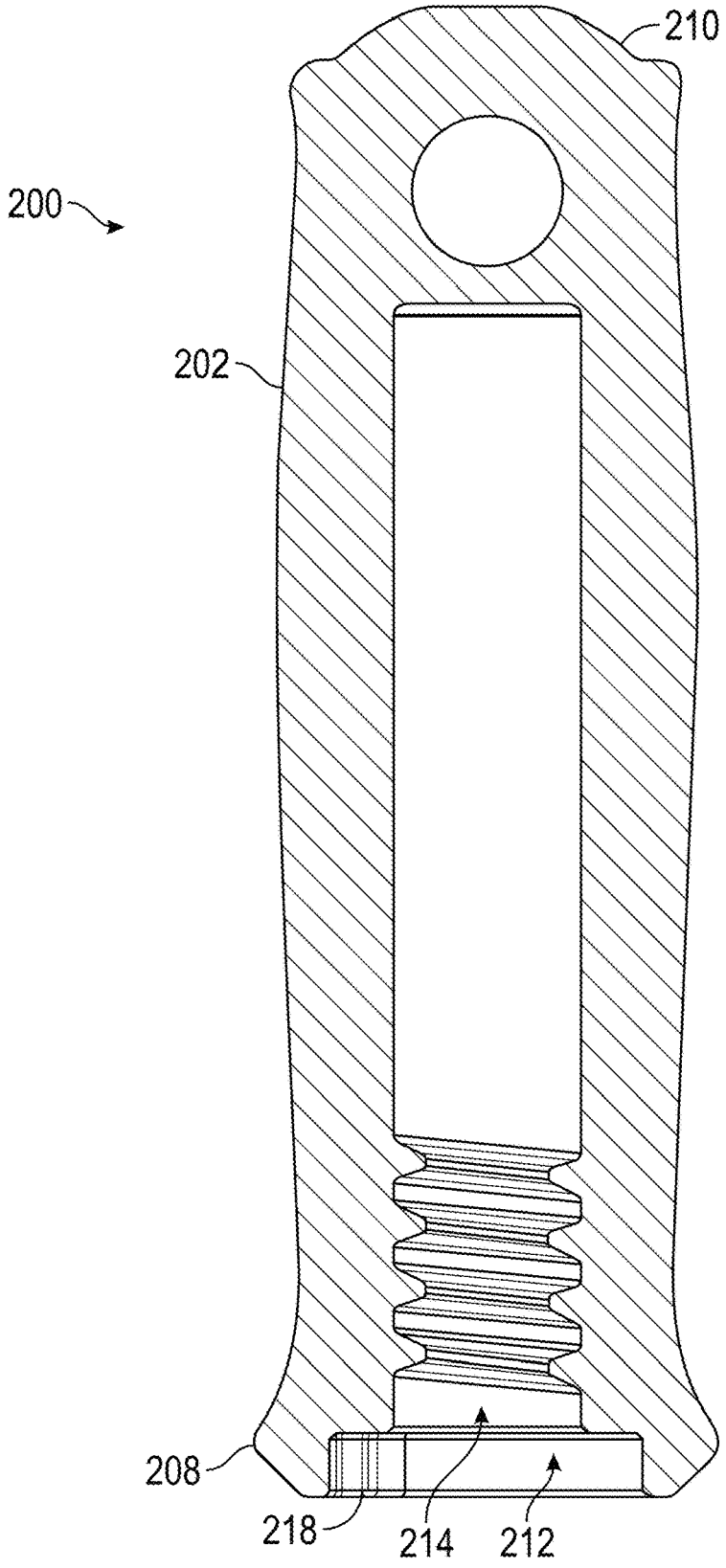

Referring now to FIGS. 26A-26C, another embodiment is shown of a grip member 200. The grip member 200 includes a contoured outer surface 202 that is shaped to be comfortably held by the operators hand in a variety of different positions. The surface 202 may a curves or ribs 204 that facilitate or improve the operator's grip of the grip member 200. In an embodiment, an optional hole 206 may extend through the grip member 200. The hole 206 provides a convenient means for the user to hang or store the handle 100. The grip member 200 includes a first end 208 and a closed second end 210.

The first end 208 includes a recess 212 having a threaded counter bore 214. The recess 212 includes a sidewall 216 that includes and at least one locking tooth 218. In the illustrated embodiment, the recess has a pair of equally spaced or opposing locking teeth 218. It should be appreciated that the recess 212 may include any suitable number of locking teeth 218. The locking teeth 218 each include a cam surface 220 and a locking surface 222. Extending into the grip member 200 is the threaded counter bore 214. In the illustrated embodiment, the threaded counter bore is a fastener sized to cooperate with the fasteners 114, 124 to selectively couple the grip member 200 to the locking member 112 or connecting member 108. In an embodiment, the recess 212 and the counter bore 214 are arranged coaxially with the longitudinal axis of the grip member 200.

Similar to grip member 110, when the user desires to use an implement that couples with connecting member 108, the user threads the grip member 200 onto the threads of locking member 112 until the locking arms 126 engage the locking teeth 218 to releasably secure the grip member 200 to the locking member 112. When the user desires to use an implement that connects to the locking member 112, the user squeezes the locking arms 126 to release the tabs 138 from the locking teeth 218 and unthreads the grip member 200. The user then proceeds to engage the threads 114 with the threaded counter bore 214 to couple the grip member 200 to the opposite end.

It should be appreciated that similar to the grip member 110, the grip member 200 provides for a single grip member that can couple to both ends of the pole 102. Thus allowing the user to connect the handle 100 to use the handle 100 with an implement that connects to the locking member 112 or the connecting member 108 and still have a comfortable grip member on the opposite end.

It should be noted that the terms "first," "second," "upper," "top," "bottom," "lower," and the like may be used herein to modify various elements. These modifiers do not imply a spatial, sequential, or hierarchical order to modify the elements unless specifically stated. The term "about" is intended to include the degree of error associated with measurement of the particular quantity based upon the equipment available at the time of filing the application.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A dual ended handle comprising:

a pole with a first pole end and a second pole end, the first pole end having a first male threaded fastener and an implement connecting feature having a tapered cone, the second pole end having a second male threaded fastener and a locking member; and a grip having a first grip end having a first female threaded counter bore and a tapered portion configured to releasably engage at least one of the first male threaded fastener and the implement connecting feature of the first pole end, and a second grip end having a second female threaded counter bore and a locking portion configured to releasably engage the second male threaded fastener of the second pole end.

2. The handle of claim 1, wherein the locking portion of the second grip end further comprises at least one locking tooth configured to engage the locking member and selectively prevent unthreading of the grip.

3. The handle of claim 2, wherein the locking member includes a locking arm configured to engage the at least one locking tooth.

4. The handle of claim 3, wherein the at least one locking tooth is disposed within a recess.

5. The handle of claim 4, wherein the second female threaded counter bore extends from the recess.

6. The handle of claim 1, wherein the first grip end includes an opening sized to receive the tapered cone, the opening having the tapered portion positioned to engage the tapered cone when the first grip end is coupled to the first pole end.

7. The handle of claim 6, wherein the first male threaded fastener is within the first female threaded counter bore extending from the opening.

8. The handle of claim 1, wherein the first male threaded fastener and the second male threaded fastener are the same thread size.

9. The handle of claim 1, wherein the grip includes a hole extending therethrough transverse to a longitudinal axis of the grip.

10. A dual ended handle comprising:

a hollow pole with a first pole end and an opposing second pole end;

a connection member coupled to the first pole end, the connection member having a first male threaded fastener and an implement connecting feature having a tapered cone;

a locking member coupled to the second pole end, the locking member having a second male threaded fastener and a locking means; and a grip having a first grip end and a second grip end, the first grip end having a first female threaded counter bore and a tapered portion configured to selectively couple with the connection member, the second grip end having a second female threaded counter bore and a locking portion configured to selectively couple with the locking member.

11. The dual ended handle of claim 10, wherein:

the locking means includes at least one arm that is movable between a first position and a second position; and the locking portion of the second grip end includes a recess having at least one locking tooth, the at least one arm and at least one locking tooth cooperating to selectively prevent uncoupling of the grip from the locking member when the grip is coupled to the locking member.

12. The dual ended handle of claim 11, wherein the grip member is configured to uncouple from the locking member when the at least one arm is in the first position.

13. The dual ended handle of claim 11, wherein the second grip end includes the second female threaded counter bore sized to couple with the second male threaded fastener.

14. The dual ended handle of claim 13, wherein the at least one arm moves from the second position to the first position in response to contacting the at least one tooth as the second male threaded fastener is coupled to the second female threaded counter bore.

15. The dual ended handle of claim 10, wherein: the first grip end includes an opening having the tapered portion, the tapered portion engaging the tapered cone when the grip is coupled to the connection member; and the first grip end includes the first female threaded counter bore sized to couple with the first male threaded fastener.

16. The dual ended handle of claim 10, wherein the grip further includes a hole extending therethrough, the hole being arranged transverse to a longitudinal axis of the grip.

* * * * *